US006016418A

United States Patent [19]

Kabeya et al.

[11] Patent Number: 6,016,418

[45] **Date of Patent: *Jan. 18, 2000**

[54] IMAGE FORMING APPARATUS

[75] Inventors: Nobuaki Kabeya, Toride; Akihiko Takeuchi, Yokohama; Toshihiko Ochiai, Tokyo; Motoi Katoh, Yokohama; Toshiaki Miyashiro, Ichikawa; Takehiko Suzuki; Takao Kume, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,136

[22] Filed: Sep. 19, 1997

Related U.S. Application Data

[63] Continuation of application No. 08/707,498, Sep. 24, 1996, abandoned, which is a continuation of application No. 08/388,413, Feb. 14, 1995, abandoned.

[30] Foreign Application Priority Data

Feb. 14, 1994 [JP] Japan ..... 6-037556
Feb. 7, 1995 [JP] Japan ..... 7-019294

[51] Int. Cl.[7] ..... G03G 15/16

[52] U.S. Cl. ..... 399/314; 399/297; 399/310

[58] Field of Search ..... 399/297, 298, 399/303, 310, 313, 314

[56] References Cited

U.S. PATENT DOCUMENTS

| | | |
|---|---|---|
| 5,113,226 | 5/1992 | Tadokoro et al. . |
| 5,130,758 | 7/1992 | Takeda et al. . |
| 5,179,397 | 1/1993 | Ohzeki et al. . |
| 5,182,604 | 1/1993 | Asai . |
| 5,196,885 | 3/1993 | Takeuchi et al. . |
| 5,249,023 | 9/1993 | Miyashiro et al. . |
| 5,253,022 | 10/1993 | Takeuchi et al. . |
| 5,287,149 | 2/1994 | Hoshika . |
| 5,287,163 | 2/1994 | Miyashiro et al. . |
| 5,307,119 | 4/1994 | Folkins et al. . |
| 5,337,127 | 8/1994 | Imaue . |
| 5,438,398 | 8/1995 | Tanigawa et al. . |

*Primary Examiner*—Sandra Brase
*Attorney, Agent, or Firm*—Fitzpatrick, Cella, Harper & Scinto

[57] ABSTRACT

An image forming apparatus includes an image bearing member for electrostatically bearing a toner image; a dielectric member movable along an endless path through a transfer position of the image bearing member; an electroconductive member in contact with the dielectric member at a side remote from the image bearing member, wherein the electroconductive member is supplied with a voltage having a polarity opposite from that of a charge polarity of the toner image to transfer the toner image from the image bearing member onto the dielectric member at the transfer position; wherein the electroconductive member is electrically grounded to generate an electric field for transferring the toner from the dielectric member to the image bearing member at the transfer position.

14 Claims, 9 Drawing Sheets

IMAGE FORMING APPARATUS

This application is a continuation of application Ser. No. 08/707,498, filed Sep. 24, 1996, now abandoned, which is a continuation of application Ser. No. 08/388,413, filed Feb. 14, 1995, now abandoned.

FIELD OF THE INVENTION AND RELATED ART

The present invention relates to an image forming apparatus for forming an image by electrostatically transferring onto a dielectric material a toner image carried on the image bearing member, and relates to the image forming apparatus such as a copying machine and/or a printer Heretofore, a color image forming apparatus for forming a color image by transferring superimposedly and sequentially the toner image formed on the photosensitive member to the transfer material carried on the transfer drum, is widely used. In addition as the above-described transfer drum the solid transfer drum 5 as indicated in FIG. 2 has been proposed. The solid transfer drum 5 is provided with an electroconductive elastic layer 5*b* on a core metal 5*a*, and is provided with a dielectric material layer 5*c* thereon.

The toner image on the photosensitive member is transferred onto the transfer material carried on the surface of the dielectric material layer 5*c*, by applying a voltage having the polarity opposite from that of the charge polarity of the toner to the core metal 5*a*.

In order to remove the toner deposited on the solid member drum 5 it is considered that the toner is reversely transferred toward the photosensitive member from the surface of the dielectric material 5*c* layer by applying the voltage having the same polarity as the charge polarity of the toner to the core metal 5*a*.

However, in such a case, the voltage source for applying the voltage having the same polarity as the low electrode property of the toner in addition to the voltage source for applying the voltage having the polarity opposite from that of the charge polarity of the toner to the core metal 5*a* when the toner image on the photosensitive member is transferred onto the transfer material is required, and therefore, the cost of the device is high.

On the other hand, it has been also proposed that in a device transferring the toner image from the photosensitive drum onto the transfer material by feeding the transfer material to between the photosensitive drum and an electroconductive transfer roller supplied with the voltage having the polarity opposite from that of the charge polarity of the toner, the toner deposited on the transfer roller is transferred back to the photosensitive drum, by applying to the transfer roller the voltage having the same polarity as the charge polarity of the toner so that the transfer roller is cleaned.

Also in this case, there is a necessity of providing separate voltage sources for supplying the voltage to the transfer roller for the transfer and or the cleaning.

SUMMARY OF THE INVENTION

An object of the present invention is to provide an image forming apparatus in which the cost increase is suppressed.

Another object of the present invention is to provide an image forming apparatus capable of properly collecting unnecessary toner deposited on the dielectric material for transferring the toner image.

A further object of the present invention is to provide an image forming apparatus capable of stably forming the image of the high duality by preventing a deterioration of the image quality due to contaminates of the dielectric material with toner. These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
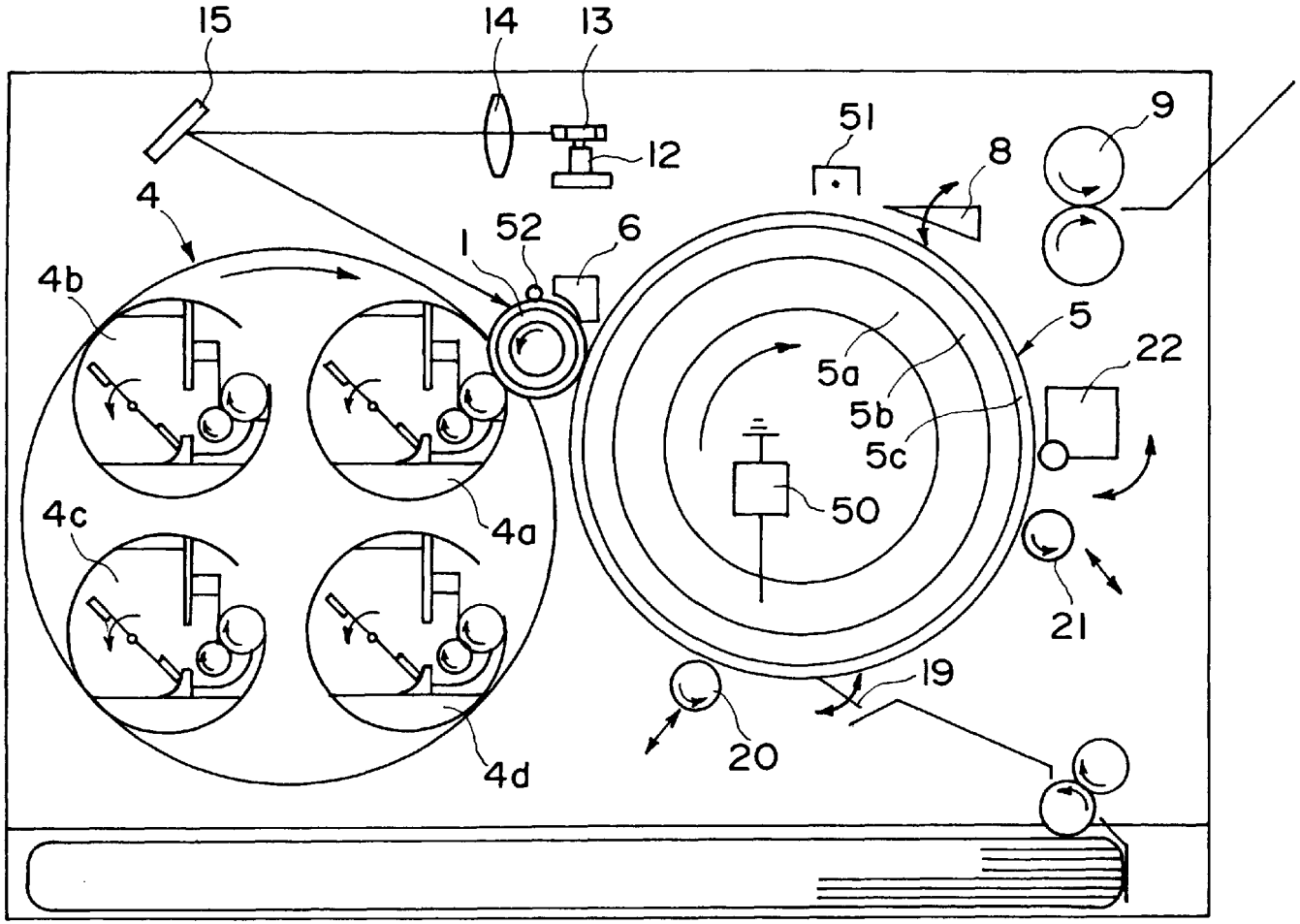
FIG. 1 is an illustration of a color image forming apparatus according to an embodiment of the present invention

A color image forging apparatus according to an embodiment of the present invention will be described referring to the accompanying drawing. FIG. 1 is an illustration at an image forming apparatus according to an embodiment of the present invention. A photosensitive drum 1 of OPC material having the negative charge polarity is used as the image bearing member in this embodiment, and toner of the positive polarity is used as the developer in a color image forming apparatus.

The toner charged to the positive polarity applied to the photosensitive drum 1 is retained on the surface of the photosensitive drum 1 by a potential of a latent image, and therefore, a toner image is formed on the photosensitive drum 1.

As indicated in FIG. 1, in the image forming apparatus, there are disposed a photosensitive drum 1 in a middle portion of the device main assembly, a solid transfer drum 5, to the right, and a rotary type developing device 4 provided with developing devices 4*a*, 4*b*, 4*c* and 4*d* accommodating the developers of yellow, magenta, cyan and black colors,for example, to the left.

The solid transfer drum comprises a core metal 5*a* of metal, an electroconductive elastic layer 5*b* thereon aid a dielectric material layer 5*c* thereon. Around the solid transfer drum, an attraction roller 20 and a discharging roller 21 comprising the electrocondvctive roller are deposited.

Above the main assembly, there are disposed a laser driver (not shown), a polygonal mirror 13 rotated by a high speed motor 12, a lens 14 and a folding mirror 15 constituting an exposure device.

With the structure as described above, in response to an exposure light based on the image signal from the exposure device, an electrostatic latent image corresponding to a first color, for example, a latent image of yellow component is formed on the photosensitive drum 1 charged uniformly by the charging means 52, and the latent image is developed by a yellow developing device 4*a* so that a yellow toner image is provided on the photosensitive drum 1.

In parallel with the process, a transfer material is supplied to the solid transfer drum 5, and the leading end of the transfer material is gripped by a gripper 19 provided in the transfer drum 5. The transfer material gripped at the leading edge is supplied with an attraction bias −500 V in this embodiment at the back surface of the transfer material, by the attraction roller 20 contacting to it so that the transfer material is retained by electrostatic attraction on the surface of the transfer drum 5. The transfer material retained on the transfer drum 5 is transported to the transfer portion opposed to the photosensitive drum 1 with the rotation of the transfer drum 5, and the yellow toner image formed on the photosensitive drum 1 is transferred onto the transfer material, by the transfer bias having the polarity opposite from that of the charge polarity of the toner and applied to the core metal 5*a* of the transfer drum 5 from the voltage source 50 as the transfer charging means.

The photosensitive drum 1 from which the transfer of the yellow toner image is completed is cleaned by the cleaning blade of the cleaner 6 contacted to the surface thereof so that the remaining toner on the surface is removed. Thereafter similarly to above, an electrostatic latent image corresponding to a second color, for example, the magenta component color is formed on the photosensitive drum 1 by the exposure, and the magenta toner image is formed by the magenta developing device 4*b*, and then the magenta toner image is transferred ad overlaid on the yellow toner image already formed on the transfer material. The similar process is repeated also as to a third color and a fourth color (a cyan and a black) so that the color image of the four color toner images of black and cyan, magenta, yellow is provided an the transfer material.

In this embodiment, the above-described transfer bias is, +950 V for the first color, +1100 V for the second color, and +1250 V for the third color, and +1400 V for the fourth color.

The transfer material for which the transfer of toner images of the four colors is completed is subsequently separated from the solid transfer drum 5 by the functions of separation claws 8 and a peeling charger 51, and is transported to a fixing device 9, where the color mixture and fixing of the four color toner image is executed so that a full-color copy image is formed, and thereafter it is discharged outside the machine of the image forming apparatus. After the separation of the transfer material, the residual toner is removed from the surface of the transfer drum 5 by a cleaning method which will be described hereinafter, and in addition the surface is initialized electrically by discharging it with the discharging roller 21 In this embodiment, the discharging is carried out with AC of 3 kVpp and 2 kHz.

The description will be made as to the cleaning mode for the transfer drum 5 in this embodiment.

In this embodiment, the toner has the negative charge polarity. In other words, when the toner on the photosensitive drum 1 is transferred to the transfer material, the positive voltage is applied to the core metal 5*a* of the transfer drum 5. Therefore, the surface of the dielectric material layer 5*c* after the transfer operation is charged to the negative polarity, by the separation discharge occurring between the transfer drum 5 and the photosensitive drum 1 downstream of the transfer position (the nip portion between the photosensitive drum 1 and the transfer drum 5).

Here, in this embodiment, the photosensitive drum 1 is of OPC having the negative charging property, and it comprises a charge generation layer, and a carrier transfer layer having a thickness of 25 micron thereon, the transfer drum 5 comprises a core metal 5*a* of aluminum an elastic member 5*b* having a volume resistivity of not more than $10^4$ Ohm.cm and having a thickness of 5.5 mm wound thereon, and a dielectric material 5*c* of the volume resistivity of $10^{14}$–$10^{16}$ Ohm.cm and having a thickness of 75 micron, coated thereon.

In this embodiment, the core metal 5*a* of the transfer drum 5 charged to the negative polarity at the surface of the dielectric material layer 5*c* after the transfer completion for four colors. In other words, when the transfer material does not exist at the transfer position, is grounded, so that the surface potential immediately before the transfer position of the transfer drum 5 is made approx. −500 V. On the other hand, the photosensitive drum 1 is discharged by a contact charging means 52 or exposure means supplied with an AC voltage so that the surface potential is approx. 0 V. Thus, in this embodiment, the electric field effective to transfer the toner deposited on the surface of the dielectric material layer 5*c* at the transfer position toward the photosensitive drum 1 can be produced without applying the voltage of the negative polarity to the core metal 5*a* of the transfer drum 5.

Figure 5:
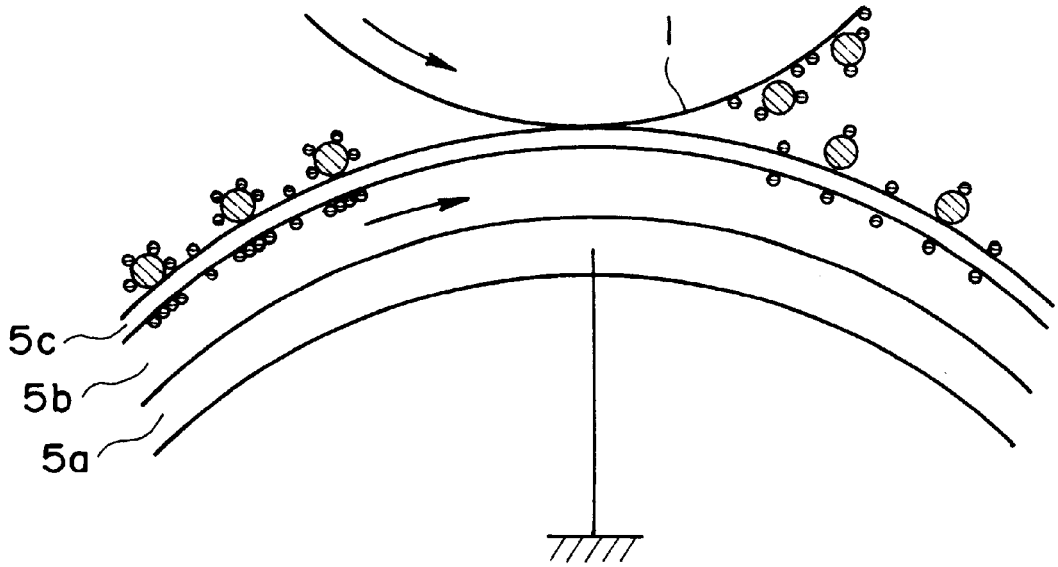
FIG. 5 is an illustration of cleaning for the transfer drum of embodiment 1.
Figure 6:
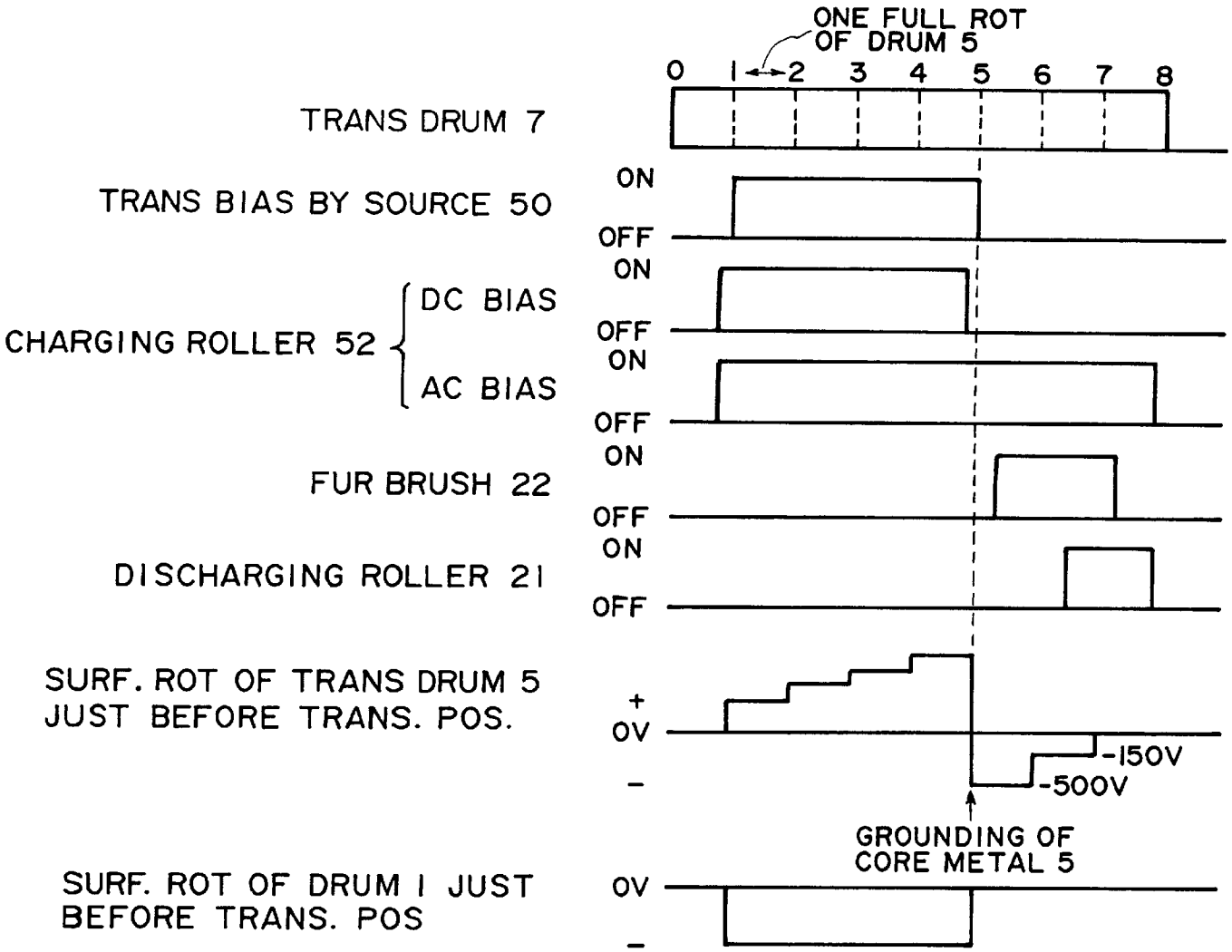
FIG. 6 is a timing chart of the cleaning and the image forming of the embodiment 1.

As shown in FIG. 5 and FIG. 6, by at least one rotation of the transfer drum 5 after grounding the core metal 5*a* of the transfer drum 5 the toner on the transfer drum 5 is transferred back to the photosensitive drum 1, and the toner is collected by the cleaner 6.

In addition, the toner on the transfer drum 5 not reverse transferred to the photosensitive drum 1 at the transfer position is collected by the fur-brush 22 provided downstream with respect to rotational direction of the transfer drum 5.

Figure 4:
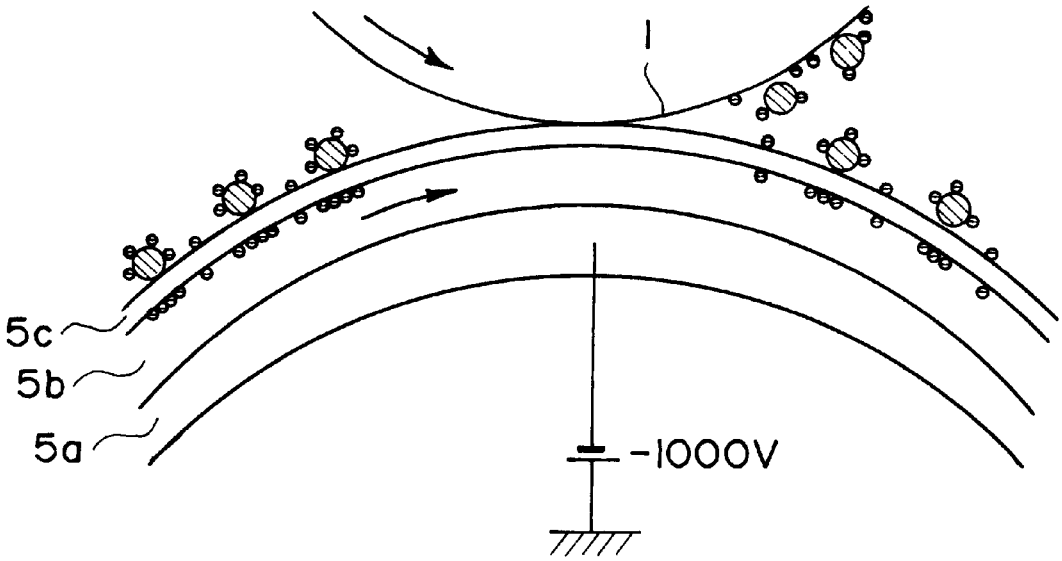
FIG. 4 is an illustration of cleaning for the transfer drum of comparison example 1.

As shown in FIG. 4 as a comparison example, the consideration will be made as to the case wherein the surface potential of the photosensitive drum 1 made 0 V, and the bias having the same polarity as the toner, here, the negative bias (−1000 V) is applied to the core metal 5*a* of the transfer drum 5, by which the toner deposited on the surface of the transfer drum 5 is transferred back onto the photosensitive drum 1. In this case, the surface potential of the transfer drum 5 at the position immediately before the transfer position is −1500 V, and the potential difference between the surface of the photosensitive drum 1 is 1500 V.

In this manner, the transfer drum 5 is provided with the dielectric material layer 5*c* on the surface, and therefore, when the surface potential of the photosensitive drum 1 is 0 V, the potential difference not less then the voltage applied to the core metal 5*a* results between the surface of the dielectric material layer 5*c* and the photosensitive drum 1.

Therefore, the discharge is produced at the transfer position so that the problem that the efficiency of the toner deposited on the dielectric material layer 5*c* transferring to the photosensitive drum 1 lowers, arises.

The toner remaining on the surface of the dielectric material layer 5*c* not transferred back to the photosensitive drum 1, in the comparison example is removed by the fur-brush 22, the problem of insufficient cleaning also arises. The cause is investigated. In the transfer region in the cleaning mode, the toner on the surface of the transfer drum transfers to the photosensitive drum, and in addition, the positive charge is injected from the photosensitive drum 1 to the transfer drum 5. Here, there is a potential difference of 1500 V, and therefore, the discharge also takes place, and movement of the excessive positive charge occurs. Therefore, the toner not reverse-transferred is charged to the positive which is opposite from that before the transfer (FIG. 4).

The surface potential of the dielectric material layer 5*c* after passing through the transfer region is −550 V, and the back side potential is −1000 V, so that the dielectric material layer 5*c* has a potential difference of 450 V. The potential difference is larger than the potential difference produced in the dielectric material layer 5*c* after the completion of the reverse transfer in this embodiment which will be described hereinafter.

The non-reverse-transferred toner in the comparison example is not easily separated from the surface of the transfer drum 5 by the Coulomb force between the charge of the back surface and the transfer drum dielectric layer 5*c*, and therefore, cleaning is difficult.

In the comparison example, a voltage source for applying the voltage of the negative polarity to the core metal 5*a* of the transfer drum 5 is required, and therefore, the cost increase of the main assembly results.

On the contrary, in this embodiment, as described above, the surface potential of the photosensitive drum 1 is made 0 V, and the core metal 5*a* of the transfer drum 5 is electrically grounded. Thus, the surface potential of the transfer drum 5 during the cleaning mode becomes −500 V, and the potential difference relative to the photosensitive drum becomes 500 V. Therefore, in the transfer position, the discharge is not produced, and the toner on the surface of the transfer drum 5 can be sufficiently transferred back onto the photosensitive drum 1. Additionally, the surface potential of the transfer drum 5 after the reverse transfer becomes −150 V (the state in which the transfer drum core metal 5*a* is grounded), and in the dielectric material layer 5*c* after the completion of the reverse transfer, there is a potential difference of 150 V which is small relative to the comparison example. Thus, the charge of the non-reverse-transferred toner can be neutralized, by which the cleaning property by the fur-brush 22 for the non-reverse-transferred toner is also improved.

As the fur-brush 22, the rayon fiber having a thickness of 250 denier is used. In addition, in the transfer drum cleaning mode, the proper cleaning property is provided by setting to 300 V–700 V the potential difference immediately before the transfer position between the transfer drum 5 and the photosensitive drum 1. Therefore, the voltage which has the same polarity as the voltage applied to the core metal 5*a* when the toner image on the photosensitive drum 1 is transferred to the transfer material and which has a small absolute value, may be applied, to the core metal 5*a* of the transfer drum 5 so that the above-described potential difference is satisfied during the cleaning mode.

Here, the surface potential of the transfer drum 5 after the completion of transfer is not constant, but changes due to the ambience and/or the print mode. The above-described example corresponds to the potential after the full-color print completion under the condition of 23°, C60%., For example, after the monochromatic print completion under the same condition, it is −300 V, and after the full-color print completion under the condition of 20° C., 10%, it is 650 V.

In addition, the above-described cleaning for the transfer drum 5, is executed upon the voltage source actuation for the device, upon the completion of continuous print, during the sheet interval in the intermittent print, and/or after the jam clearance operation.

Embodiment 2

Figure 7:
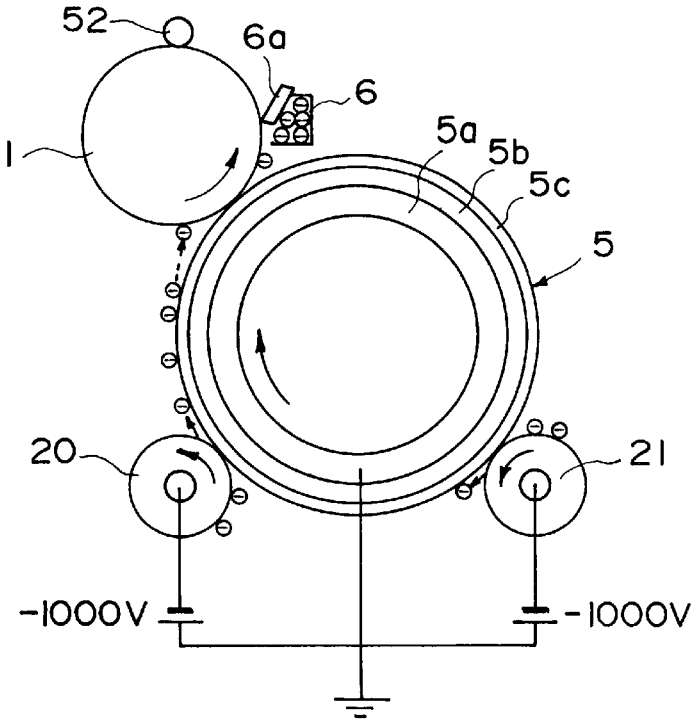
FIG. 7 is an illustration of cleaning for an attraction roller, a discharging roller and a transfer drum in the embodiment 2.
Figure 8:
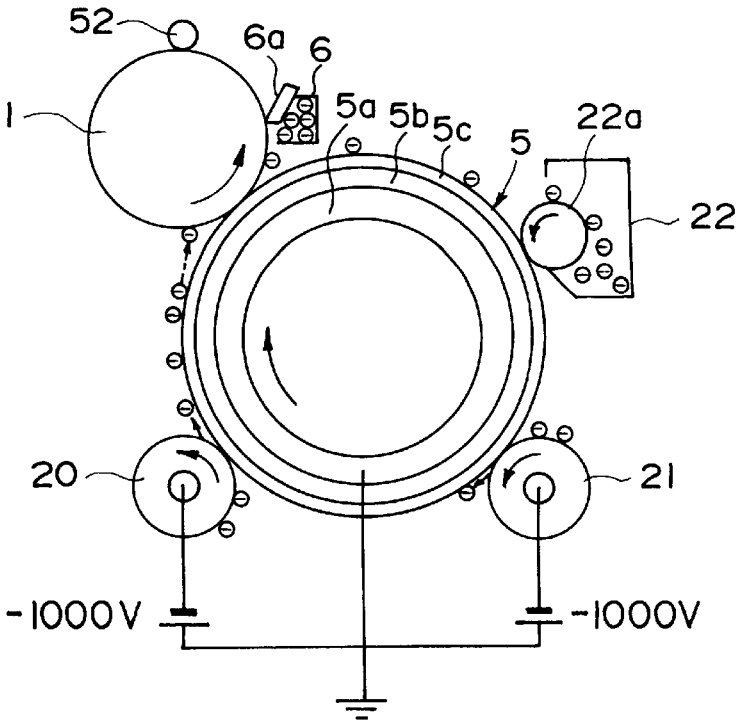
FIG. 8 is an illustration of cleaning of an attraction roller, a discharging roller and a transfer drum in embodiment 2.

In the following, embodiment 2 of the present invention, will be described referring to FIG. 7. The present embodiment is applicable to the color image forming apparatus of FIG. 1.

In this embodiment, the toner deposited on the transfer drum 5 is cleaned by reverse transfer toward the photosensitive drum 1 similarly to embodiment 1.

The apparatus of FIG. 1 is not provided with the cleaning member since the image forming apparatus is complicated if the cleaning member such as the cleaning blade is provided for each of the attraction roller 20 and the discharging roller 21. However, the cleaning of the surface of the solid transfer drum 5 is not complete, and the toner remains although quantity thereof is small. Such a small quantity of the remaining toner is accumulated, and therefore, the quantity becomes significant with repeated the image forming operations. Therefore, when the attraction roller 20 and the discharging roller 21 are contacted to the transfer drum 5, the toner on the transfer drum 5 is deposited to the surface of the rollers 20 and 21 thereof, and is accumulated.

In some cases, the toner is deposited on the attraction roller 20 and discharging roller surface also by the toner scattering or upon the jam occurrence or the like.

As a result, the resistance of the surfaces of the attraction roller 20 and the discharging roller 21 increase by which problems such as the attraction defect of the transfer material and the discharging defect of the transfer drum 5, arise. There are also the problems of providing a contamination source for the transfer drum 5 due to the toner contamination of the discharging roller 21, and of the back side contamination of the transfer material due to the toner contamination of the attraction roller 20.

In this embodiment, the attraction roller 20, the discharging roller 21 are cleaned by the method shown in FIG. 6 so as to remove the toner deposited on the surface. The discharging roller 21 and the attraction roller 20 are contacted to the solid transfer drum 5, and the potential difference for moving the deposited toner on the roller 21 and 20 onto the transfer drum 5 is provided between the roller 21 and the attraction roller 20 and the transfer drum 5. The toner is re-transferred to the transfer drum 5 from the rollers 21 and 20 by the electric field. Subsequently, between the transfer drum 5 and the photosensitive drum 1, a potential difference for transferring the re-transfer toner on the transfer drum 5 onto the photosensitive drum 1 is applied, and the toner is re-transferred onto the photosensitive drum 1 from the transfer drum 5 by the electric field. And, the re-transferred toner on the photosensitive drum 1 is removed by the cleaner 6. By this, the deposited toner can be removed from the attraction roller 20 and the discharging roller 21, and the removed toner is collected to the cleaner 6 by the photosensitive drum 1.

In a specific example of this embodiment, the core metal 5*a* of the solid transfer drum 5 is an aluminum cylinder, and the electroconductive elastic layer 5*b* on the core metal 5*a* has the thickness of 5.8 mm, and has the volume resistivity of $10^4$ Ohm.cm or lower, and furthermore, the dielectric material layer 5*c* is formed thereon by a dielectric material sheet having a thickness of 75 micron and a volume resistivity of $10^{14}$–$10^{16}$ Ohm.cm. For dielectric rollers for the attraction roller 20 and the discharging roller 21, the use is made with foamed sponge of electroconductive EPDM or CR rubber having a rubber hardness of 35° in Asker C2 hardness, and having a volume resistivity of $10^5$ Ohm.cm or lower.

The surface potentials of the rollers 20, 21, the transfer drum 5 and the photosensitive drum 1 during the cleaning of the attraction roller 20 and the discharging roller 21, are selected in the following manner. The charge polarity of the toner is the positive similarly to embodiment 1. The cleaning is carried out after the completion of the transfer of the toner image of the final color in the intermittent print mode.

Each surface potential is as follows:

The photosensitive drum potential:0 V

The attraction roller potential: −1000 V

The discharging roller potential: −1000 V

The transfer drum potential: −500 V

The attraction roller 20 and the discharging roller 21 are electroconductive rollers, aid therefore the applied bias equals to the surface potential. On the other hand, the photosensitive drum 1 is discharged to 0 V using known discharging means (the discharging exposure or the discharging means for charge removal 52). The surface potential of the transfer drum 5 is determined by the charge on the dielectric material layer 5*c* after the transfer of the toner image of the fourth color, that is, the final color. In this embodiment, the transfer bias is positive, and therefore, the charge of the positive polarity is accumulated after the transfer on the surface of the dielectric material layer 5*c*. Therefore, similarly to embodiment 1, after the transfer of the toner image of the fourth color, the core metal 5*a* is grounded. By this, the transfer bias is made to 0 V, by which the surface potential of the transfer drum 5 is made approx. −500 V.

As described in the foregoing, in this embodiment, when the potentials of the discharging rollers the attraction and are Vs, the surface potential of the transfer drum is Vt, and the surface potential of the photosensitive drum is Vd, the cleaning mode having the potential relationship such that $Vs-Vt<0$ and $Vt-Vd<0$ (in the case of the charge polarity of the toner is the positive polarity) is satisfied, is provided, so that the deposited toner can be removed by re-transferring from the discharging roller 21 and the attraction roller 20 onto the transfer drum 5.

Thus, the toner is re-transferred onto the photosensitive drum 1 so that it can be collected by the cleaner 6. However, in the case that the charge polarity of the toner is the positive, $Vs-Vt>0$ and $Vt-Vd>0$.

Therefore, according to the present embodiment, the toner contamination of the attraction roller 20 and the discharging roller 21 is removed so that the attraction defect of the transfer material toward the transfer drum 5, the discharging defect of the transfer drum 5 and/or the contamination of the transfer material can be prevented. As a result, the proper color image can be provided stably. Additionally, it is not necessary to provide a separate cleaning member for the attraction roller 20 or the discharging roller 21, and therefore the structure of the image forming apparatus, can be simplified. Furthermore, the toner removed from the attraction roller 20 and the discharging roller 21 can be collected all together by the cleaner 6 for the photosensitive drum 1, and therefore the problem of stagnation of the residual toner for each cleaning member for the roller can be avoided.

Figure 2:
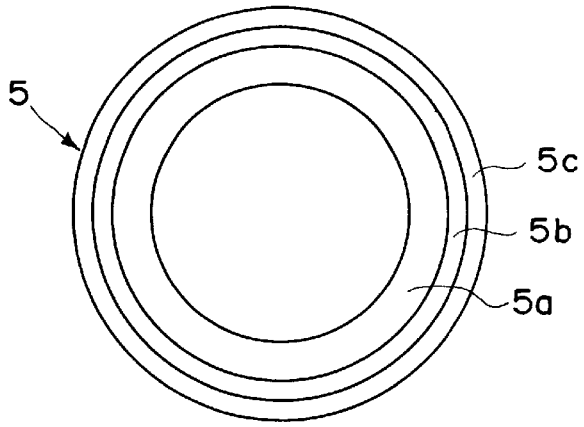
FIG. 2 is a sectional view of a layer structure of a solid transfer drum provided in the device of FIG. 1.
Figure 3:
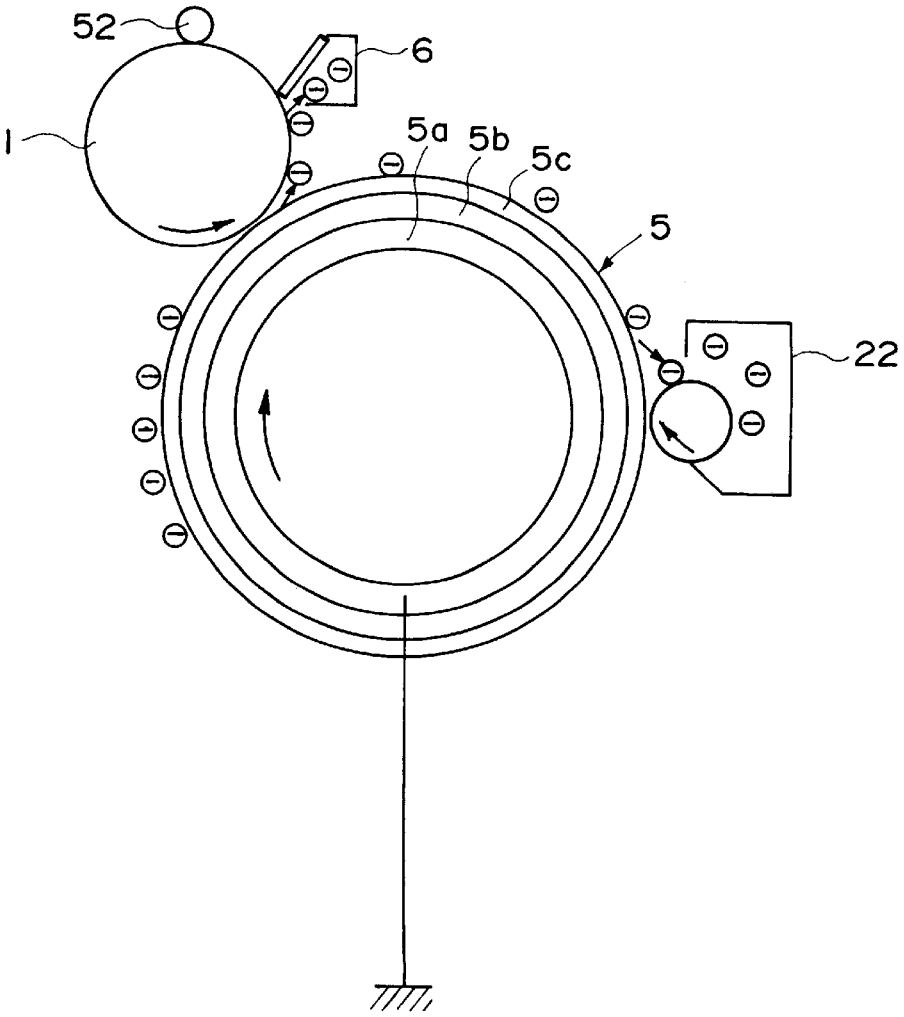
FIG. 3 is an illustration of a cleaning operation for the transfer drum in embodiment 1.

In addition, in this embodiment, as shown in FIG. 2, the transfer drum cleaner 22 may be provided to collect by the fur-brush 22*a* the toner not reverse-transferred to the photosensitive drum 1 from the transfer drum 5.

An example of the fiber of the fur-brush 22*a* is a rayon fiber of 250 denier.

In this manner, by removing the toner from the transfer drum 5 by the fur-brush 22*a* for the transfer cleaner 22, the toner mixed with the foreign matter such as paper dust which is not easily removed only by the electric field control, and the toner having a low amount of electric charge, can be also removed from the transfer drum 5. Accordingly, the toner contamination of the attraction roller 20 and the discharging roller 21 can be avoided, and therefore, the attraction defect of the transfer material to the transfer drum 5, the discharging defect of the transfer drum 5, and the back side contamination of the transfer material can be prevented. Thus, the effect of forming the proper and stable color image is improved more.

In place of the fur-brush 22, the cleaning blade comprising the fluorine rubber member may be provided to be contacted counterdirectionally relative to the transfer drum 5. The cleaning blade, as compared with the fur-brush 22*a* of FIG. 7, the cleaning property is excellent, and is preferably applied to the solid transfer drum 5, and has the advantage of inexpensiveness.

Embodiment 3

Figure 9:
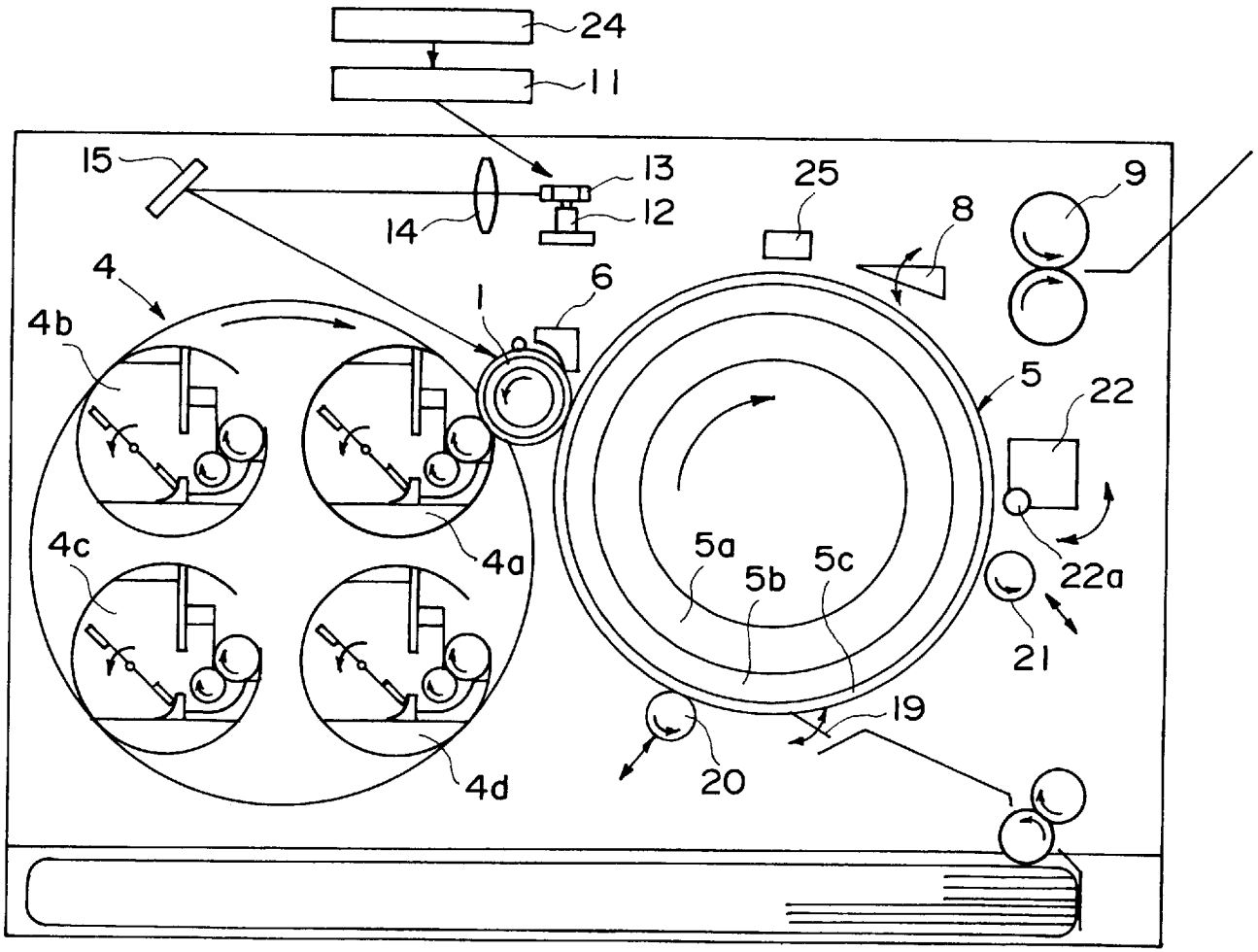
FIG. 9 is an illustration of a color image forming apparatus according to embodiment 3.
Figure 10:
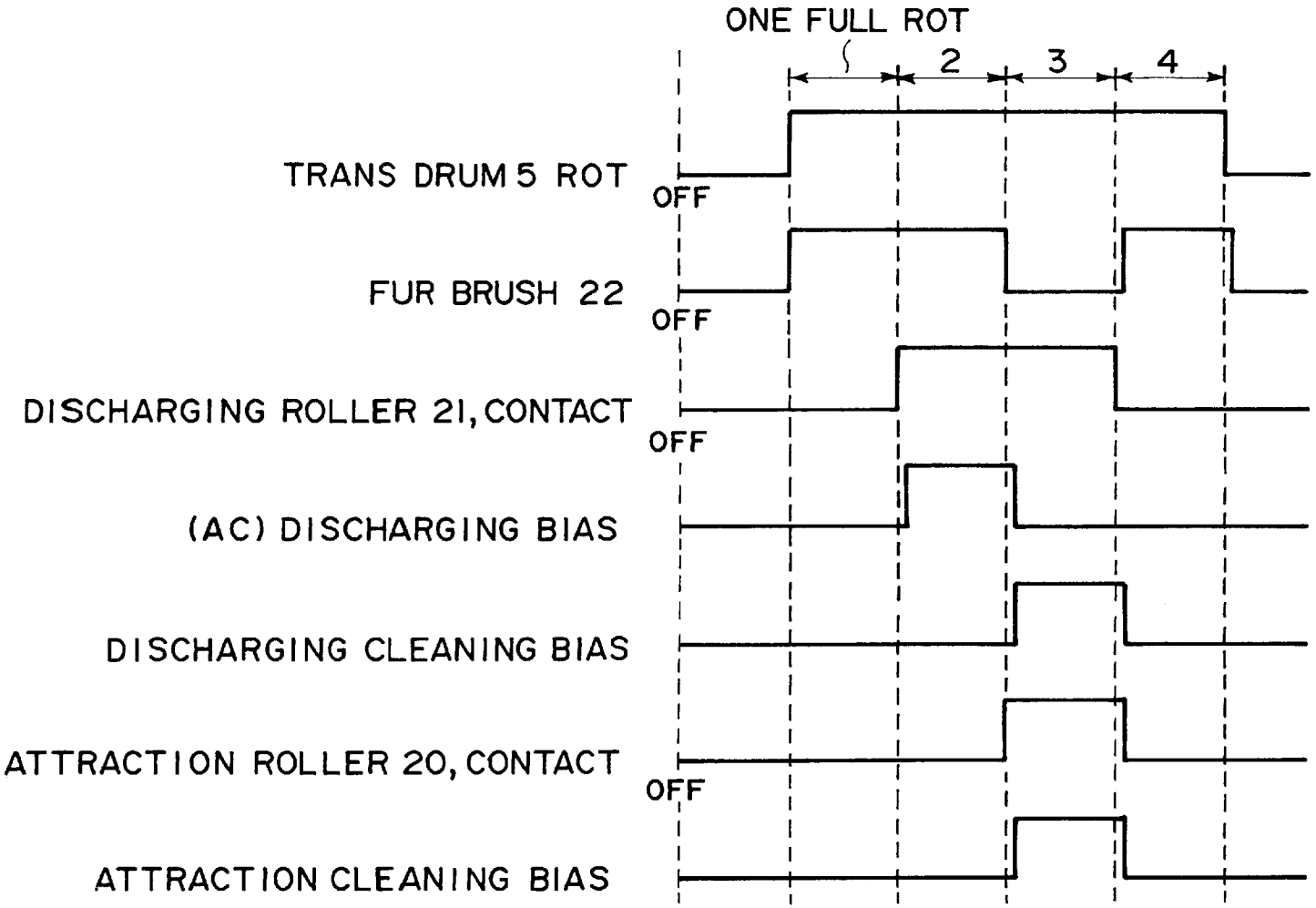
FIG. 10 is a timing chart of cleaning for an attraction roller, a discharging roller and a transfer drum according to embodiment 3.

Referring to FIG. 9 and FIG. 10, embodiment 3 of the present invention will be described.

In this embodiment, the description will be made as to the case that the cleaning operation for the solid transfer drum 5 is carried out upon completion of patch image density detection. The image density control using the patch image density detection system is carried out for the purpose of stably providing the image of the high image quality even after the continued image formation on the multiple sheets and/or even upon the ambient condition change.

As shown in FIG. 6, the image signal of the patch image for the density control is produced by the pattern production circuit 24 of the image forming apparatus, and the laser driver 11 is driven in accordance with the signal so as to form the latent image of patch image for each color on the photosensitive drum 1. It is developed so that each color patch image is formed with the toner on the photosensitive drum 1. The patch image is transferred onto the transfer drum 5 under the state in which the attraction roller 20 is released from the transfer drum 5. The transfer bias of the patch image is directly applied onto the transfer drum 5, and therefore, the value lower than in the case of transferring onto the transfer material, is used. In this embodiment, for example, the patch image is transferred onto the transfer drum 5 by application, to the core metal 5*a*, of the transfer bias of +200 V for the first color—the fourth color. The toner density of patch image of each color transferred onto the transfer drum 5, is measured by a density sensor 25, and the proper value of the developing bias of developing devices 4*a*–4*d* for respective color is determinated on the basis of the measurement density to control it.

In this manner, by the patch image density detection system, the image density control is executed, so that even after the continuous image forming on the multiple sheets and/or even upon the ambience change, the image of the high image quality can be provided stably.

On the other hand, the patch image of each color transferred onto the solid transfer drum 5 is removed by the transfer cleaner 22(the fur-brush 22*a*) by rotating the transfer drum 5, as indicated in FIG. 10. Subsequently, the discharging roller 21 is contacted to the transfer drum 5, and the discharging bias (AC) is applied to discharge it. Thereafter, the discharging cleaning bias (DC bias) applied to the discharging roller 21 is made −600 V, and the transfer bias is made 0 V so that the transfer drum surface potential is made −100 V. Thus, the deposited toner on the discharging roller 21 is re-transferred onto the transfer drum 5, and the toner thus re-transferred is removed by the transfer cleaner 22. Each bias is made zero a predetermined time after the re-transfer onto the transfer drum 5, and is returned the normal stand-by mode (awaiting mode).

In this manner, the density detection operation is executed during sheet interval period, and the surface potential of the transfer drum 5 is low as compared with the sheet passing period, and therefore, as for the cleaning of the discharging roller 21 upon the completion of the patch image density detection, the bias applied to the discharging roller 21 may be lowered. It is preferable to execute the density control upon the voltage source actuation, when the stand-by state continues for a time not less than a predetermined time, or when the ambient condition change is observed during the stand-by period.

In this embodiment, the patch image formed on the transfer drum 5 may be cleaned similarly to embodiment 1.

More particularly, after the completion of the density detection, the core metal 5*a* of the transfer drum 5 is grounded to discharge the photosensitive drum 1, by which the electric field for transferring the toner on the transfer drum 5 to the photosensitive drum 1 at the transfer position, is produced to pass the region of the transfer drum 5 having a formed the patch image in the transfer position. The toner reverse-transferred to the photosensitive drum 1 from the transfer drum 5 is collected by the photosensitive drum cleaner 6.

Embodiment 4

The removing of the toner deposited on the attraction roller 20 and the discharging roller 21 in the color image forming apparatus of FIG. 1, will be described.

In embodiment 1, the surface potential of 500 V of the transfer drum 5 after the transfer operation is produced by selecting 0 V as the transfer bias applied to the core metal 5*a* of the transfer drum 5. However, if the transfer bias is not 0 V but approx. +1000 V, the surface potential of the transfer drum 5 can be raised up to about +500 V. Therefore, if this is done, and thereafter the attraction roller 20 and the discharging roller 21 is grounded to 0 V, and it is contacted to the transfer drum 5, then, similarly to embodiment 2, the deposited toner on the attraction roller 20 and the discharging roller 21 can be returned and re-transferred to the transfer drum 5.

The toner deposited on the transfer drum 5 is cleaned through the method which is similar to embodiment 1.

According to the present embodiment, it is not necessary to particularly add the bias voltage, for the cleaning, to the attraction roller 20 and/or the discharging roller 21. For the discharging of the transfer drum 5 by the discharging roller 20, the bias AC of normally 1–4 kV (peak-to-peak voltage) is frequently used, and therefore, the face that the DC bias voltage source for the cleaning for the deposited toner on the discharging roller 20 can be omitted permits significant cost saving.

If the contact between the photosensitive drum 1 and the transfer drum 5 is releasable, and the cleaning mode for the discharging roller 21 and the attraction roller 20 is carried out in the released state, then it can be avoided that the toner contamination on the photosensitive drum 1 transfers onto the transfer drum 5. Additionally, the transfer memory is not produced on the photosensitive drum 1, and therefore it is further preferable.

Embodiment 5

Figure 11:
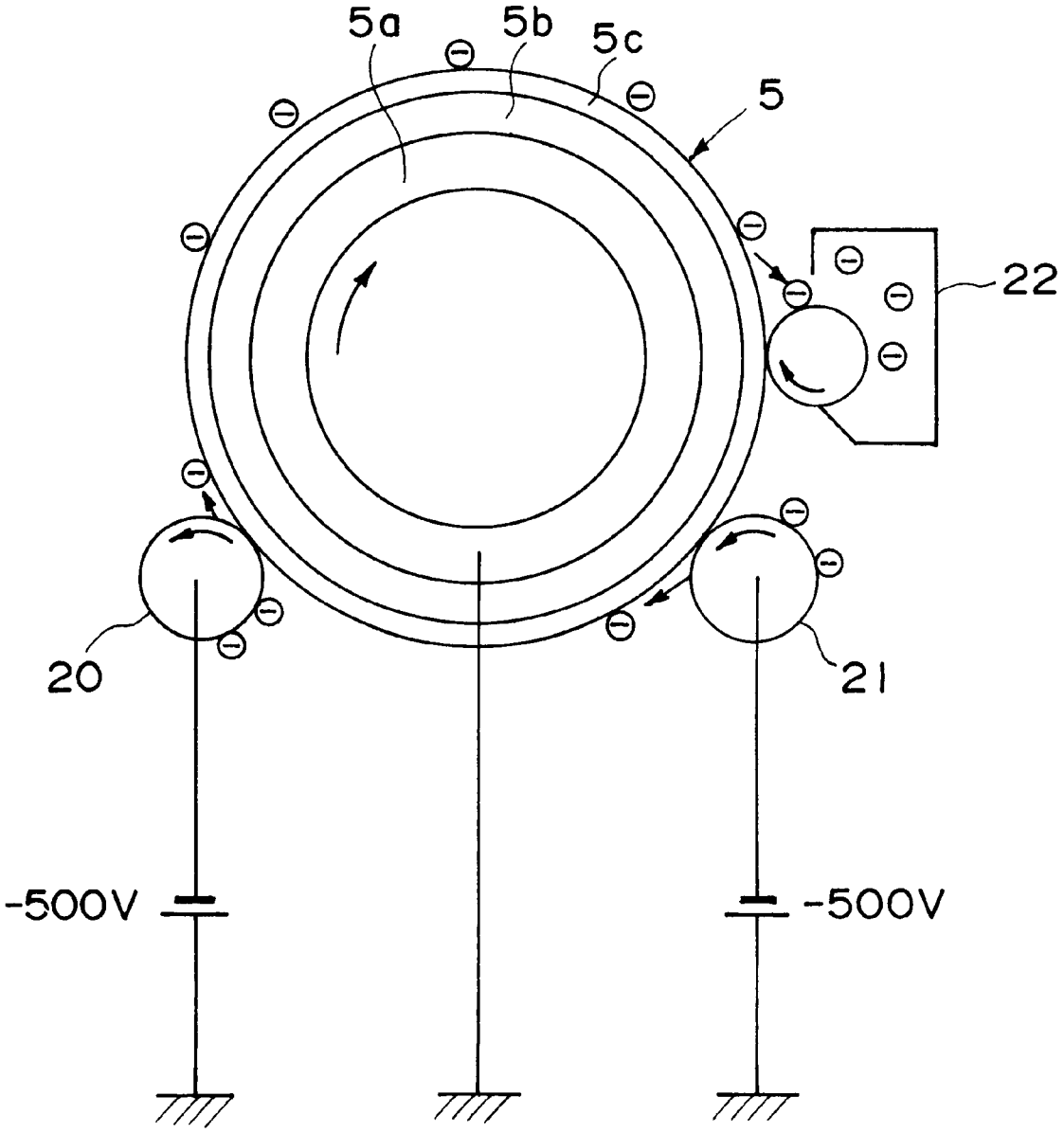
FIG. 11 is an illustration of cleaning for an attraction roller and a discharging roller of embodiment 5.

Referring to FIG. 11 embodiment 5 of the present invention will be described.

As for the discharging roller 21 and the attraction roller 20, if the cleaning member such as the cleaning blade is provided particularly, the device becomes complicated. Therefore, the cleaning member therefor is not provided. Therefore, when the toner is deposited on the surface of the transfer drum 5, the toner is deposited to the attraction and discharging rollers, when they are contacted thereto. In addition, in some cases, the toner is directly deposited to the roller upon the jam clearance operation and/or by the toner scattering or the like.

In this embodiment, the cleaning mode having the potential relationship such that $Vs-Vt<0$ is satisfied (in the case of the charge polarity of the toner being positive) is provided, where the potentials of the discharging roller 21 and the attraction roller 20 is Vs, and the surface potential of the transfer drum 5 is Vt. By this, the toner deposited in the surface of the discharging roller 21 and the attraction roller 20 is removed. in the case of the positive charge polarity of the toner, the sign of inequation is opposite.

Also in the present embodiment, similarly to the foregoing embodiment, the toner has the negative charge polarity. In this embodiment, the photosensitive drum 1 comprises OPC of the negative charging, and CT layer of the thickness of 25 micron is provided on the charge production layer. The transfer drum 5 comprises a core metal 5*a* of aluminum, an elastic member 5*b* having a volume resistivity of $10^4$ Ohm.cm or lower and a thickness of 5.5 mm wound thereon, and a dielectric material 5*c* having a volume resistivity of $10^{14}$–$10^{16}$ Ohm.cm and a thickness of 75 micron, coated thereon. The discharging roller 21 and the attraction roller 20 comprise a foamed sponge of electroconductive EPDM or CR rubber having a volume resistivity of $10^5$ Ohm.cm or lower, and having a rubber hardness of 35° in Asker C2 hardness. The transfer drum cleaning mode described in embodiment 1 is executed so that the toner on the surface of the transfer drum 5 after the transfer material separation is removed, and it is discharged by the discharging roller 21 to be initialized electrically. Therefore, the surface potential of the transfer drum 5 at this time is 0 V.

In this embodiment, as shown in FIG. 11, the core metal 5*a* of the transfer drum 5 is grounded, and the attraction roller 20 and the discharging roller 21 are supplied with −500 V, and are contacted to a transfer drum 5. The attraction roller 20 and the discharging roller 21 are electroconductive rollers, and therefore the applied bias is equal to the surface potential. Here, each surface potential is as follows:

Transfer drum 5 surface potential: 0 V

Attraction roller 20 surface potential: −500 V

Discharging roller 21 surface potential −500 V

By this, the toner charged to the negative and deposited on the surface of the discharging roller 21 and the attraction roller 20, is transferred to the transfer drum 5 by the potential difference. Thereafter, the toner transferred to the transfer drum 5 is removed by contacting the fur-brush or the cleaning blade to the transfer drum. Also in the cleaning mode, the potential differences between the discharging roller 21 and the attraction roller 20 and the transfer drum 5 are set to 300 V–700 V by which the proper cleaning property is provided.

By this, the toner deposited on the attraction roller 20 and/or the discharging roller 21 or the like contacted to the transfer drum 5, and for applying the charge can be removed, the image of the high quality without the image disturbance due to the attraction defect and/or the discharging defect can he provided.

In addition, if the contact between the photosensitive drum 1 and the transfer drum 5 is releasable, and the cleaning mode of the attraction roller 20 and the discharging roller 21 is executed in the released state, the transition of the toner contamination on the photosensitive drum 1 onto the transfer drum 5 can be prevented. In addition, the transfer memory is not produced on the photosensitive drum 1, and therefore it is preferable.

Embodiment 6

Figure 12:
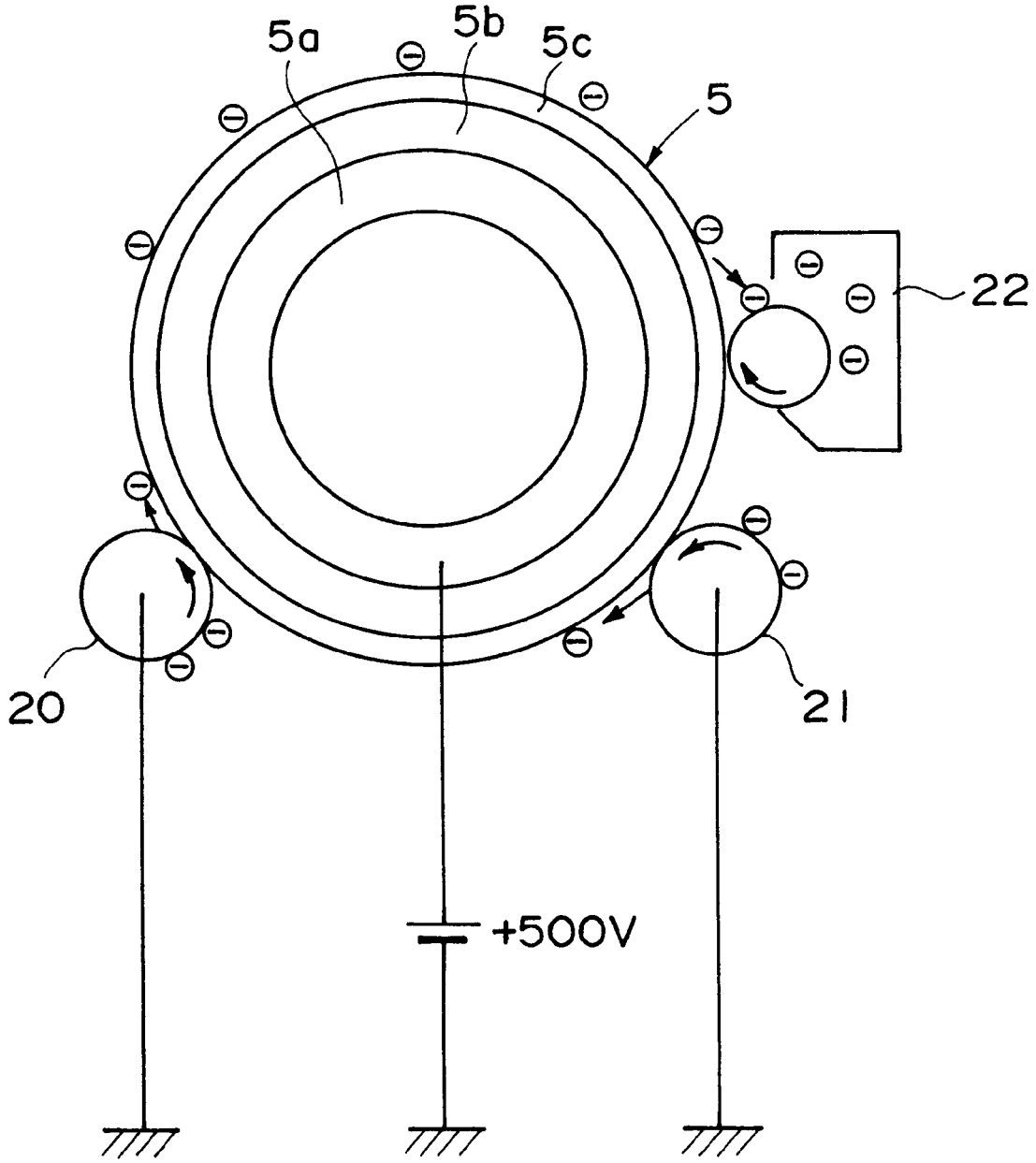
FIG. 12 is an illustration of cleaning for an attraction roller and a discharging roller according to embodiment 6.

Embodiment 6 of the present invention will be described referring to FIG. 12.

In this embodiment, the cleaning mode having the potential relationship such that $Vs-Vt<0$ is satisfied (in the case of the charge polarity of the toner being positive) is provided where the potentials of the discharging roller 21 and the attraction roller 20 is Vs, and the surface potential of the transfer drum 5 is Vt. By this, the toner deposited on the surface of the discharging roller 21 and the attraction roller 20 is removed. In the case of the positive charge polarity of the toner, the sign of inequation is opposite. In this embodiment, during the above-described cleaning mode, the attraction roller 20 and the discharging roller 21 are grounded, and to the core metal 5*a* of the transfer drum 5, the bias having the polarity opposite from that of the charge polarity of the toner is applied so that the above-described equation is realized.

More in detail, the transfer drum cleaning mode described in embodiment 1 is executed, and the toner on the surface of the transfer drum 5 after the transfer material separation is removed, and is electrically discharged by the discharging roller 21 to be initialized so that the surface polential of the transfer drum 5 becomes 0 V. Here, if the charge polarity of the toner is negative, 500 V is applied to the core metal 5*a* of the transfer drum 5 as indicated in FIG. 12 during thp cleaning mode execution for the attraction roller 20 and the discharging roller 21 in this embodiment, and the attraction roller 20 and the discharging roller 21 are grounded, and they are contacted to the transfer drum 5. Here, each surface potential is as follows:

Transfer drum 5 surface potential; +500 V

Attraction roller 20 surface potential; 0 V

Discharging roller 21 surface potential; 0 V

By this, the toner charged to the negative polarity and deposited to the surface of the attraction roller 20 and the discharging roller 21, is transferred to the transfer drum 5 by the potential difference. Thereafter, the toner transferred to the transfer drum 5 is removed by contacting the cleaning blade or the fur-brush to the transfer drum.

Thus, according to the present embodiment, the bias voltage source for the cleaning mode for the attraction roller 20 and/or the discharging roller 21 is not required. Particularly, for the discharging of the transfer drum 5 by the discharging roller 21, normally, 1–4 KV (peak-to-peak voltage) of AC bias is usually required, the fact that DC bias voltage source for the cleaning of the discharging roller 21 can be omitted means significant cost reduction.

In addition, if the contact between the photosensitive drum 1 and the transfer drum 5 is releasable, and the cleaning mode of the attraction roller 20 and the discharging roller 21 is executed in the released state, the transition of the toner contamination on the photosensitive drum 1 onto the transfer drum 5 can be prevented. In addition, the transfer memory is not produced on the photosensitive drum 1, and therefore it is preferable.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for electrostatically bearing a toner image;

a dielectric member movable along an endless path through a transfer position of said image bearing member, wherein said dielectric member cooperates with said image bearing member to form an image transfer nip at said transfer position;

an electroconductive member in contact with said dielectric member at a side remote from said image bearing member, wherein said electroconductive member is supplied with a transfer potential having a polarity opposite from that of a charge polarity of the toner image when the toner image is transferred at the image transfer nip;

wherein said electroconductive member is supplied with a potential having a polarity the same as that of said transfer potential and having a lower level than said transfer potential or with a ground potential while a surface of said dielectric member carries a charge with a polarity which is the same as the polarity of the toner, so as to generate an electric field for transferring the toner from said dielectric member to said image bearing member at the transfer position.

2. An apparatus according to claim 1, wherein the electric field is produced during at least one rotation of said dielectric member.

3. An apparatus according to claim 1, further comprising image forming means for forming the toner image on said image bearing member, density detection means for detecting a density of the toner image transferred onto said dielectric member, control means for controlling an image forming condition of said image forming means on the basis of an output of said density detection means, after the density detection by the density detection means, the toner image detected by said density detection means is transferred to said image bearing member by the electric field.

4. An apparatus according to claim 2 or 3, further comprising cleaning means for removing the toner from said image bearing member.

5. An apparatus according to claim 1, further comprising toner collect means for collecting the toner from said dielectric member, provided downstream of the transfer position with respect to movement direction of said dielectric member.

6. An apparatus according to claim 1, wherein said dielectric member carries a transfer material to the transfer position, and the toner image on said image bearing member is transferred onto the transfer material carried on the dielectric member.

7. An apparatus according to claim 6, wherein said electroconductive member is electrically grounded, when there is no transfer material at the transfer position to generate the electric field for transferring the toner to said image bearing member from said dielectric member at the transfer position.

8. An apparatus according to claim 6, further comprising attraction means for supplying charge by contacting said dielectric member to attract the transfer material to said dielectric member, and means for producing an electric field for transferring the toner to said dielectric member from said attraction means, when the electric field for transferring the toner to said image bearing member from said dielectric member is produced at the transfer position.

9. An apparatus according to claim 1 or 8, further comprising discharging means for discharging said dielectric member in contact thereto, and means for producing an electric field for transferring to said dielectric member the toner from said discharging means, when a potential difference for transferring the toner to said image bearing member from dielectric member at the transfer position is produced.

10. An apparatus according to a claim 6, wherein the toner image is repeatedly transferred and overlaid sequentially from said image bearing member onto the transfer material carried on said dielectric member to form a full-color image.

11. An apparatus according to claim 1, further comprising discharging means for discharging said image bearing member, wherein a region of said image bearing member at the transfer position when the electric field for transferring the toner to said image bearing member from said dielectric member at the transfer position is produced has been discharged by said discharging means.

12. An image forming apparatus according to claim 1;

wherein said electroconductive member is electrically grounded to generate said electric field.

13. An apparatus according to claim 1, wherein said charge includes charge produced during image transfer.

14. An apparatus according to claim 1 or 7, wherein said image bearing member has a charging polarity which is the same as that of the charge polarity of the toner.

* * * * *

UNITED STATES PATENT AND TRADEMARK OFFICE

CERTIFICATE OF CORRECTION

PATENT NO. : 6,016,418

DATED : January 18, 2000

INVENTOR(S): NOBUAKI KABEYA, ET AL.

It is certified that error appears in the above-identified patent and that said Letters Patent is hereby corrected as shown below:

COLUMN 1:
Line 57, "or" should read --for--.

COLUMN 2:
Line 2, "contaminates" should read --contamination--; and
Line 66, "aid" should read --and--.

COLUMN 3:
Line 2, "electrocondvctive" should read --electroconductive--; and
Line 61, "21" should read --21.--.

COLUMN 4:
Line 12, "thereon," should read --thereon.--; and "the" should read --The--;
Line 46, "made" should read --is made--;
Line 62, "problem" should read --problem arises--; and
Line 64, "lowers, arises." should read --decreases.--.

COLUMN 5:
Line 64, "23°, C60%.," should read --23°C, 60% RH.--.

UNITED STATES PATENT AND TRADEMARK OFFICE

CERTIFICATE OF CORRECTION

PATENT NO. : 6,016,418

DATED : January 18, 2000

INVENTOR(S): NOBUAKI KABEYA, ET AL.

It is certified that error appears in the above-identified patent and that said Letters Patent is hereby corrected as shown below:

COLUMN 6:
Line 21, "quantity" should read --the quantity--; and
Line 23, "repeated the" should read --repeated--.

COLUMN 7:
Line 2, "the use" should read --use--;
Line 3, "with" should read --of--;
Line 11, "the positive" should read --positive,--;
Line 21, "aid" should read --and--; and
Line 22, "to" should be deleted.

COLUMN 9:
Line 31, "a" should be deleted;
Line 40, "500" should read -- -500--;
Line 47, "21 is" should read --21 are--; and
Line 60, "face" should read --fact--.

COLUMN 10:
Line 26, "in" should read --In--.

UNITED STATES PATENT AND TRADEMARK OFFICE

CERTIFICATE OF CORRECTION

PATENT NO. : 6,016,418

DATED : January 18, 2000

INVENTOR(S): NOBUAKI KABEYA, ET AL.

It is certified that error appears in the above-identified patent and that said Letters Patent is hereby corrected as shown below:

COLUMN 11:

Line 5, "the image" should read --and the image--;

Line 35, "More in detail," should read --In more detail,--; and

Line 39, "polential" should read --potential--.

COLUMN 13:

Line 15, "from" should read --from said--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*